US009138982B2

(12) United States Patent
Paul et al.

(10) Patent No.: US 9,138,982 B2
(45) Date of Patent: Sep. 22, 2015

(54) IMAGE DATA BASED TEMPERATURE CONTROL OF A KEYLESS INKER

(75) Inventors: Peter Paul, Webster, NY (US); Jorge A. Alvarez, Webster, NY (US); Nancy Y. Jia, Webster, NY (US); Charles Donahue Rizzolo, Fairport, NY (US); Augusto E. Barton, Palo Alto, CA (US)

(73) Assignee: Xerox Corporation, Norwalk, CT (US)

( * ) Notice: Subject to any disclaimer, the term of this patent is extended or adjusted under 35 U.S.C. 154(b) by 189 days.

(21) Appl. No.: 13/356,308

(22) Filed: Jan. 23, 2012

(65) Prior Publication Data

US 2013/0186291 A1 Jul. 25, 2013

(51) Int. Cl.

| | |
|---|---|
| ***B41F 31/02*** | (2006.01) |
| ***B41F 13/22*** | (2006.01) |
| ***B41F 31/00*** | (2006.01) |
| ***B41F 31/04*** | (2006.01) |
| ***B41F 33/10*** | (2006.01) |

(52) U.S. Cl.

CPC ..... *B41F 13/22* (2013.01); *B41F 31/00* (2013.01); *B41F 31/002* (2013.01); *B41F 31/04* (2013.01); *B41F 33/10* (2013.01)

(58) Field of Classification Search

CPC .... B41F 31/002; B41F 31/005; B41F 31/045; B41F 33/0045; B41F 33/0063; B41F 33/0027; B41F 31/02; B41F 35/02; B41P 2227/70; B41P 2233/11; B41N 3/006

USPC ..... 101/365, 483, 484, 485, 487, 478, 101/DIG. 47, DIG. 45

See application file for complete search history.

(56) References Cited

U.S. PATENT DOCUMENTS

| | | | | |
|---|---|---|---|---|
| 4,619,198 | A | 10/1986 | Moll | |
| 4,665,824 | A * | 5/1987 | Greiner et al. | 101/492 |
| 4,690,055 | A | 9/1987 | Fadner et al. | |
| 5,130,920 | A | 7/1992 | Gebo | |
| 5,207,158 | A | 5/1993 | Fadner et al. | |
| 5,218,905 | A | 6/1993 | Bolte et al. | |
| 5,967,049 | A * | 10/1999 | Seymour et al. | 101/484 |
| 6,477,954 | B1 | 11/2002 | Doherty | |
| 6,832,550 | B2 * | 12/2004 | Martin et al. | 101/349.1 |
| 6,871,029 | B2 | 3/2005 | Brewington et al. | |
| 6,958,183 | B2 | 10/2005 | Okamura et al. | |
| 7,059,245 | B2 * | 6/2006 | Mayer et al. | 101/365 |
| 7,191,705 | B2 | 3/2007 | Berg et al. | |
| 7,425,073 | B2 | 9/2008 | Wood et al. | |
| 2005/0028696 | A1 | 2/2005 | Price et al. | |
| 2006/0169157 | A1 | 8/2006 | Gahan | |
| 2011/0024400 | A1 | 2/2011 | Rumsby | |
| 2011/0114729 | A1 | 5/2011 | Moon et al. | |
| 2012/0103214 | A1 * | 5/2012 | Stowe et al. | 101/363 |

*Primary Examiner* — Daniel J Colilla

* cited by examiner

*Assistant Examiner* — Leo T Hinze

(74) *Attorney, Agent, or Firm* — Ronald E. Prass, Jr.; Prass LLP

(57) ABSTRACT

A method and systems to control the temperature of a Keyless inker for variable data lithography printing. Inker heating elements are adjustable to control ink feed to individual zones located across the width of an ink roller. Feedforward and feedback control loops adjust the ink supply dynamically based on a pixel count of the image content. The pixel count looks ahead in the video stream to allow time for the adjustment at the inker heating elements to propagate through the inker unit to affect ink output onto the imaging drum surface. Feedback of the achieved ink density on control patches on the imaging drum is also used to command the inker heating elements. Feedback is also used to update the inker propagation delay and dynamic model used to determine how much the inker keys need to be adjusted based on the pixel count stream.

12 Claims, 12 Drawing Sheets

IMAGE DATA BASED TEMPERATURE CONTROL OF A KEYLESS INKER

CROSS REFERENCE TO RELATED PATENTS AND APPLICATIONS

This application is related to the following co-pending applications, which is hereby incorporated by reference in its entirety: "JOINT FEEDFORWARD AND FEEDBACK CONTROL OF A KEYED INK TRAIN FOR UNIFORM INKING IN DIGITAL OFFSET PRINTING SYSTEMS", filed as U.S. patent application Ser. No. 13/356,254 on Jan. 23, 2012, and published as U.S. Patent Application Publication No. 2013/0186290 A1, by Peter Paul et al.

This application is related to the following co-pending applications, which is hereby incorporated by reference in its entirety: "IMAGE FEEDFORWARD LASER POWER CONTROL FOR A MULTI-MIRROR BASED HIGH POWER IMAGER", filed as U.S. patent application Ser. No. 13/356,213 on Jan. 23, 2012, and issued as U.S. Pat. No. 8,508,791 on Aug. 13, 2013 to Peter Paul et al.

This application is related to the following co-pending applications, which is hereby incorporated by reference in its entirety: "VARIABLE DATA LITHOGRAPHY SYSTEM", filed as U.S. patent application Ser. No. 13/095,714 on Apr. 27, 2011, and published as U.S. Patent Application Publication No. 2012/0103212 A1, by Timothy D. Stowe et al.

BACKGROUND

The present disclosure is related to marking and printing methods and systems, and more specifically to automatically control the temperature of a Keyless inker for variable data lithographic printing based on pixel counting.

Offset lithography is a common method of printing today. (For the purpose hereof, the terms "printing" and "marking" are interchangeable.) In a typical lithographic process a printing plate, which may be a flat plate, the surface of a cylinder, belt, etcetera, is formed to have "image regions" formed of hydrophobic and oleophilic material, and "non-image regions" formed of a hydrophilic material. The image regions are regions corresponding to the areas on the final print (i.e., the target substrate) that are occupied by a printing or a marking material such as ink, whereas the non-image regions are the regions corresponding to the areas on the final print that are not occupied by the marking material.

The Variable Data Lithography (also referred to as Digital Lithography or Digital Offset) printing process begins with a fountain solution used to dampen a silicone imaging plate on an imaging drum. The fountain solution forms a film on the silicone plate that is on the order of about one (1) micron thick. The drum rotates to an exposure station where a high power laser imager is used to remove the fountain solution at the locations where the image pixels are to be formed. This forms a fountain solution based latent image. The drum then further rotates to a development station where lithographic ink is brought into contact with the fountain solution based latent image and ink develops onto the places where the laser has removed the fountain solution. The ink is hydrophobic. An ultra violet (UV) light may be applied so that photo-initiators in the ink may partially cure the ink to prepare it for high efficiency transfer to a print media such as paper or clothe. The drum then rotates to a transfer station where the ink is transferred to a printing media such as paper. The silicone plate is compliant, so an offset blanket is not used to aid transfer. UV light may be applied to the paper with ink to fully cure the ink on the paper. The ink is on the order of one (1) micron pile height on the paper.

The inking process is one of the main differences between traditional lithographic offset printing and variable data lithographic printing is that every image can be different, as in all digital printing. This is often referred to as Variable Data printing. Traditional lithographic offset is inherently a reprographic process in that all images for each revolution of the image drum are the same. Thus the mean ink throughput for each drum revolution is the same, and the critical ink-to-fountain-solution ratio is the same for each revolution. The process is tuned manually by an operator to find the correct ink supply rate to match the ink load and the image content, and to also match the ink and fountain solution mixture. The operator makes ink supply adjustments and visually inspects the printed output to perform the manual tuning process.

Skilled operators perform this function in traditional lithographic offset printing. Note that this is for a static document, which is a document that is the same for every revolution of the imaging drum. For variable data documents the challenge is even greater because the ink load presented by the image content is varying. If not enough ink is supplied, a starvation defect will occur similar to the xerographic defect known as "ghosting", or "reload". The final (or potentially intermediate) inker rollers cannot pick up enough ink from their upstream supply rollers to keep up with the demand presented by the image. Note that the ink trains and particularly the final inker rollers are somewhat robust to ink load variation in that the circumference of the ink rollers are typically many times smaller than the circumference of the image drum (which is the extent of the printed image). Thus the inker rollers are robust enough to handle local variations in the ink load, as long as the mean ink supply meets the mean ink load. Where the mean is taken, at least, over one imaging drum revolution. If too much ink is supplied to the inker rollers, then fine detail in the image will be washed out resulting in poor image quality. Again, the inker rollers are robust to this in that they can handle local variations in ink load for at least one revolution of the imaging drum. In traditional lithographic offset printing, once the operator has tuned the system for ink supply rate and fountain solution rate, the system reaches a quasi-equilibrium in that the mean ink load for one drum revolution is fixed and thus the required ink supply is fixed. The adjustments are made every 1 inch or so in the cross-process direction. Thus for a cross process location that does not have much image content such as text, a key setting associated with a low ink supply is chosen to match the ink load in that cross-process location. In a cross process location that has high image content such as a solid fill, a key setting associated with a high ink supply is chosen, again, to match the ink load in that cross-process location. Note that in all cross-process locations, whether they have high ink load or low ink load, the total ink load over an imaging drum revolution is the same (high, low, or in between) from revolution to revolution.

Typically, for a keyless inker in traditional lithographic printing the ink supply may be adjusted by manually adjusting the temperature of an ink bath. For Variable Data printing, the ink load will be different in both the cross-process and process directions. That is, the ink load will change in each process and cross-process location over time as the document is printed, since each page of the document can have different content. The ink supply system must automatically adjust to match ink supply with the dynamic ink load presented by the variable data image content. The ink baths are typically adjusted manually by a human operator when the printing unit is in a maintenance mode. While the past practices have been reasonably satisfactory, there is a need for an improved ink bath temperature adjustment mechanism so as to automatically adjust the ink flowing into in a variable data lithography system.

SUMMARY

A method and systems to automatically control the temperature of a Keyless inker for variable data lithographic printing based on pixel counting is provided. The ink baths having heaters adjustable to control the ink feed to individual zones located adjacent to each other across the width of an ink roller. The system uses feedforward and feedback control loops to adjust the ink supply dynamically based on a pixel count of the image content. The pixel count looks ahead in the video stream far enough to allow for time for the adjustment at the ink bath heaters to propagate through the ink train to affect ink output at the ink train onto the imaging drum. Feedback of the achieved ink density on control patches on the imaging drum is used in addition to the pixel count to command the ink bath heaters. Feedback is also used to update the inker propagation delay and dynamic model used to determine how much the ink bath heaters need to be adjusted based on the pixel count stream.

DETAILED DESCRIPTION

Figure 1:
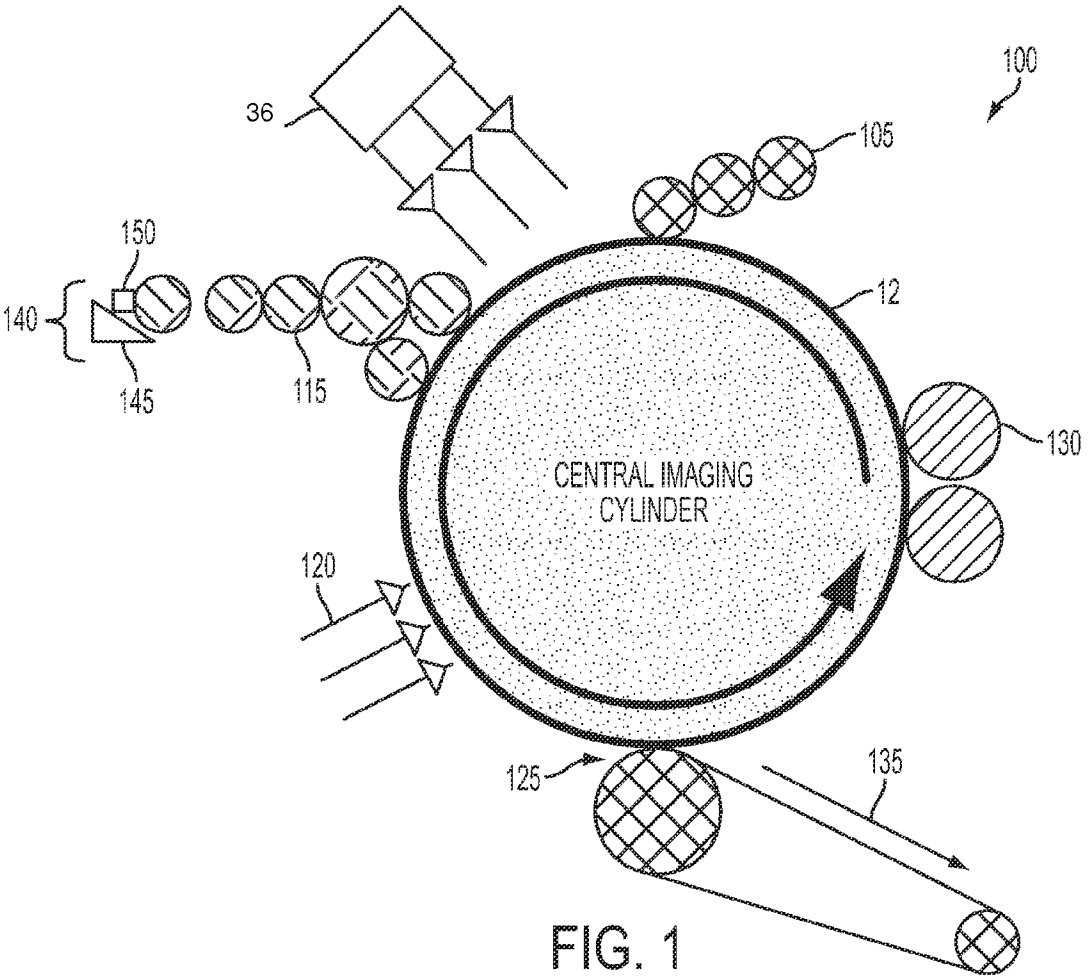
FIG. 1 is a side view of a system for variable data lithography in accordance to an embodiment.

The disclosed embodiment pertains to an automatic ink supply method for lithographic offset printing systems which includes variable data lithographic systems. The ink control system uses the video stream, measuring pixel count, to automatically adjust the ink temperature and therefore the ink supply to match the ink load of the image content. In addition to the predictive estimates from pixel count, closed loop control can be accomplished using control patches on the imaging drum to control ink supply and other key attributes such as inker propagation delay and the dynamic model used to determine ink supply versus pixel count. Automatic ink and fountain solution control is essential when a non repetitive or variable data digital image is used and the ink and fountain solution demand varies with the changing digital image content.

Aspects of the disclosed embodiments relate to a system to control ink bath temperature for a variable data lithographic printing machine comprising a plurality of ink baths adjacent to each other across the width of a roller in a printing machine, each bath adaptable to control the ink feed to individual zones, the system comprising a feedforward controller responsive to an ink load demand for an image to provide an output in accordance to a first control function which is adaptable to control the temperature of the at least one ink bath; and at least one heater element to control the temperature of the at least one ink bath in response to the feedforward controller.

In yet further aspects of the disclosed embodiments the system further comprising a feedback controller to adapt the first control function and operative in accordance to an inker dynamic model for the printing machine; wherein the ink load demand is based on a pixel count of the image that has been separated into cross-process direction sub-images associated with at least one ink bath.

In yet further aspects of the disclosed embodiments wherein the ink load demand comprises at least one of dynamics of the at least one ink bath, dynamics of the ink train, delay in applying ink to an imaging member in the printing machine.

In yet further aspects of the disclosed embodiments wherein the inker dynamic model is based on at least one of ink density measurement, ink density target, ink load at time of density measurement, feedback gain, or a combination thereof.

In yet further aspects of the disclosed embodiments wherein the inker dynamic model is updated with at least one of data obtained after printing of the image, data obtained before printing of the image using density patches at predetermined locations of the imaging member, data obtained after printing a number of images.

In yet further aspects of the disclosed embodiments wherein the at least one heater element is selected from a group consisting of resistive heater, inductive heater, electric heater, pipe heater.

In yet further aspects of the disclosed embodiments wherein the feedforward controller and the feedback controller are responsive to an ink density measurement obtained from an imaging member.

Aspects of the disclosed embodiments relate to a method to control ink bath temperature of a keyless inking unit for a printing machine comprising at least one heating element configured to heat the ink bath, the method comprising receiving a print job comprising at least one image; separating the at least one image into cross-process direction sub-images associated with each heating element and associated ink bath zone; providing an output in accordance to a first control function which is adaptable to control the temperature of the at least one ink bath zone; and controlling at least one heater element to control the temperature of the at least one ink bath zone.

Aspects of the disclosed embodiments relate to an apparatus to control ink bath temperature for a keyless inking unit in a printing machine, the apparatus comprising: at least one ink bath zone comprising an ink bath, wherein each ink bath zone is positioned adjacent to each other across the width of a roller; at least one heater element to control the temperature of the at least one ink bath zone; at least one sensor for measuring ink density of the ink on an imaging member; and a memory for storing an inker dynamic model for the inking unit and for storing executable instructions to control the temperature of the at least one ink bath zone, the executable instructions capable of directing a processor to perform: receiving a print job comprising at least one image; separating the at least one image into cross-process direction sub-images associated with the at least one ink bath zone; providing an output in accordance to a first control function which is adaptable to control the temperature of the at least one ink bath zone based on an ink load demand for each sub-image; controlling the at least one heater element to adjust the ink supply in the at least one ink bath zone in accordance to the first control function; updating the stored inker dynamic model for the inking unit with the measured ink density.

Embodiments as disclosed herein may also include computer-readable media for carrying or having computer-executable instructions or data structures stored thereon for operating such devices as controllers, sensors, and eletromechanical devices. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

The term "print media" generally refers to a usually flexible, sometimes curled, physical sheet of paper, clothe, cardboard, plastic or composite sheet film, ceramic, glass, or other suitable physical print media substrate for images.

The term "variable data printing" generally refers to a system that can print or mark variable data documents, that is, documents that vary in image content from page-to-page. A "variable data lithographic printing machine" performs variable data printing.

The term "ink train" is used to describe a series of rollers or other mechanisms used to carry ink to an imaging member for printing of a print media.

The term "ink unit" or "inker" is intended to comprise an ink train, ink bath, and one or more ink fountains for supplying ink to the ink train in proportion to settings of at least one ink bath aligned with a respective ink path along which ink is transferred from one ink fountain to a substrate or image on an imager member to be printed.

As used herein relational terms such as "first," "second," and the like may be used solely to distinguish one entity or action from another entity or action without necessarily requiring or implying any actual such relationship or order between such entities or actions. Also, relational terms, such as "offset", "upstream", "downstream", "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

FIGS. 8-12 show the hardware and operating environment of variable data lithography in which different embodiments can be practiced.

Figure 8:
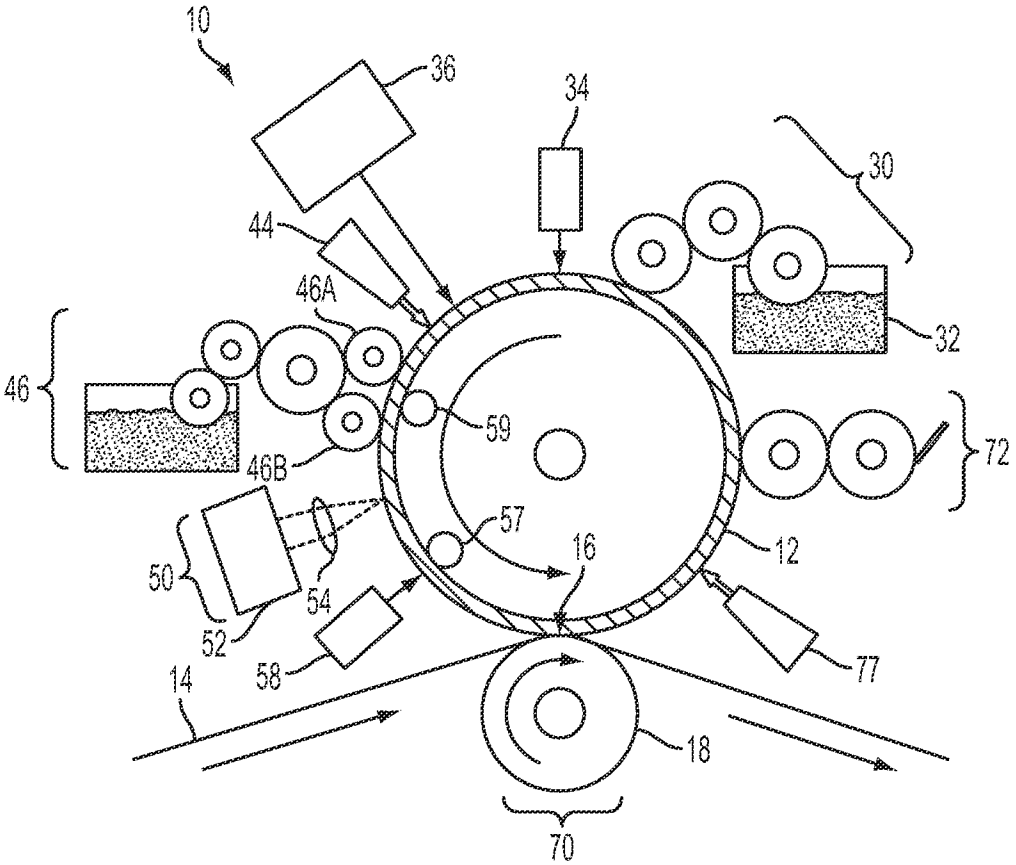
FIG. 8 is a side view of a system for variable data lithography in accordance to an embodiment.

FIG. 8 illustrates therein a system 10 for variable data lithography according to one embodiment of the present disclosure. System 10 comprises an imaging member 12, in this embodiment a drum, but may equivalently be a plate, belt, and the like, surrounded by a number of subsystems described in detail below. Imaging member 12 applies an ink image to substrate 14 at nip 16 where substrate 14 is pinched between imaging member 12 and an impression roller 18. A wide variety of types of substrates, such as paper, plastic or composite sheet film, ceramic, glass, and the like may be employed. For clarity and brevity of this explanation we assume the substrate is paper, with the understanding that the present disclosure is not limited to that form of substrate. For example, other substrates may include cardboard, corrugated packaging materials, wood, ceramic tiles, fabrics (e.g., clothing, drapery, garments and the like), transparency or plastic film, metal foils, and the like. A wide latitude of marking materials may be used including those with pigment densities greater than ten percent (10%) by weight including but not limited to metallic inks or white inks useful for packaging. For clarity and brevity of this portion of the disclosure we generally use the term ink, which will be understood to include the range of marking materials such as inks, pigments, and other materials which may be applied by systems and methods disclosed herein. The inked image from imaging member 12 may be applied to a wide variety of substrate formats, from small to large, without departing from the present disclosure. In one embodiment, imaging member 12 is at least 38 inches (38") wide so that standard 4 sheet signature page or larger media format may be accommodated. The diameter of imaging member 12 must be large enough to accommodate various subsystems around its peripheral surface. In one embodiment, imaging member 12 has a diameter of 10 inches, although larger or smaller diameters may be appropriate depending upon the application of the present disclosure.

As shown in FIG. 8, at a first location around imaging member 12 is a dampening solution subsystem 30. Dampening solution subsystem 30 generally comprises a series of rollers (referred to as a dampening unit) for uniformly wetting the surface of reimageable surface layer 20. It is well known that many different types and configurations of dampening units exist. The purpose of the dampening unit is to deliver a layer of dampening solution 32 having a uniform and controllable thickness. In one embodiment this layer is in the range of 0.2 μm to 1.0 μm, and very uniform without pin holes. The dampening solution 32 may be composed mainly of water, optionally with small amounts of isopropyl alcohol or ethanol added to reduce its natural surface tension as well as lower the evaporation energy necessary for subsequent laser patterning. In addition, a suitable surfactant is ideally added in a small percentage by weight, which promotes a high amount of wetting to the reimageable surface layer 20. In one embodiment, this surfactant consists of silicone glycol copolymer families such as trisiloxane copolyol or dimethiconecopolyol compounds which readily promote even spreading and surface tensions below 22 dynes/cm at a small percentage addition by weight. Other fluorosurfactants are also possible surface tension reducers. Optionally dampening solution 32 may contain a radiation sensitive dye to partially absorb laser energy in the process of patterning, described further below. In addition to or in substitution for chemical methods, physical/electrical methods may be used to facilitate the wetting of dampening solution 32 over the reimageable surface layer 20. In one example, electrostatic assist operates by way of the application of a high electric field between the dampening roller and reimageable surface layer 20 to attract a uniform film of dampening solution 32 onto reimageable surface layer 20. The field can be created by applying a voltage between the dampening roller and the reimageable surface layer 20 or by depositing a transient but sufficiently persisting charge on the reimageable surface layer 20, itself. The dampening solution 32 may be electronically conductive. Therefore, in this embodiment an insulating layer (not shown) may be added to the dampening roller and/or under reimageable surface layer 20. Using electrostatic assist, it may be possible to reduce or eliminate the surfactant from the dampening solution.

Figure 2:
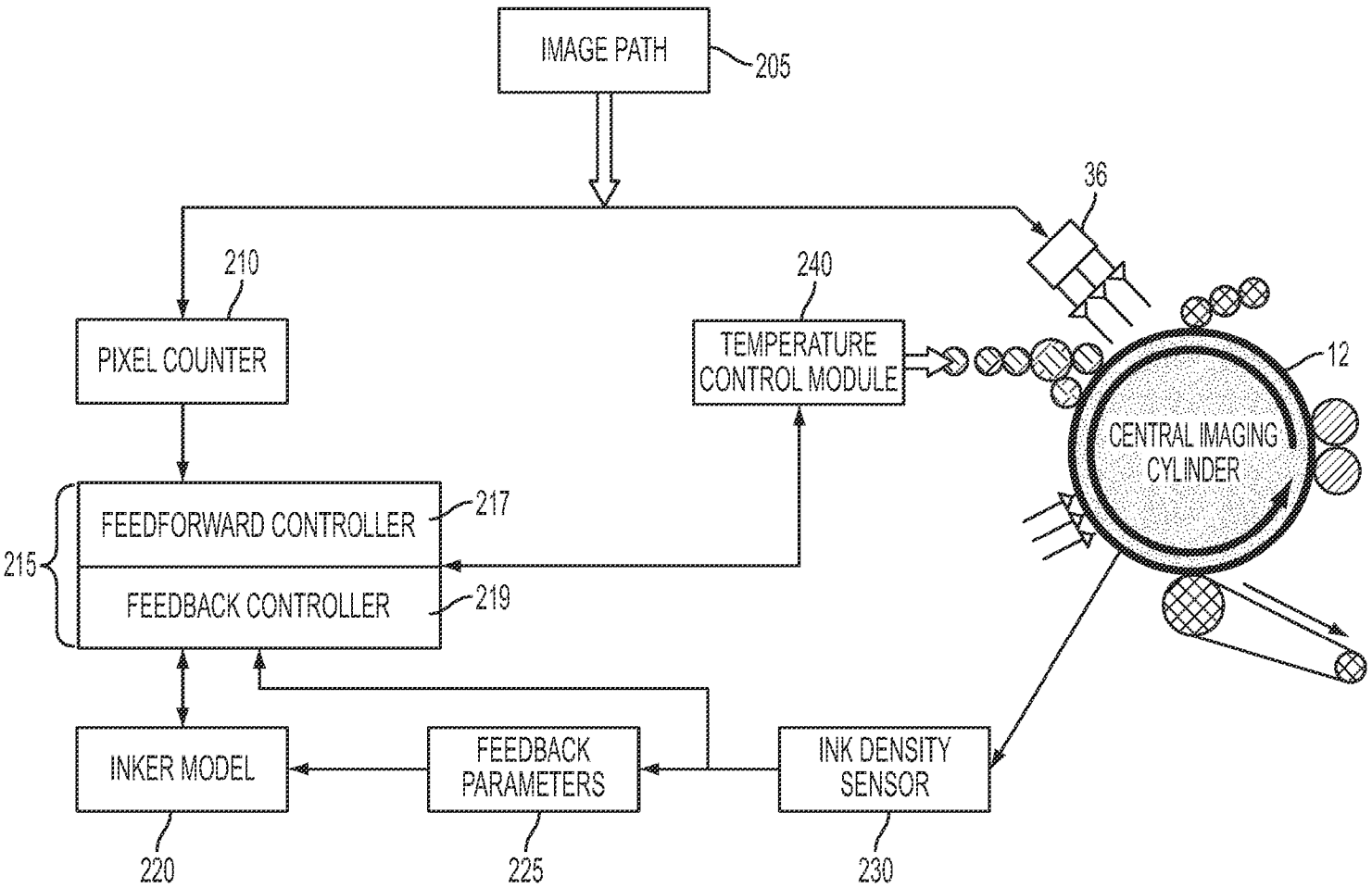
FIG. 2 is a schematic side elevation view of a variable data lithography system with keyless inker and feedforward and feedback control loops in accordance to an embodiment.

After applying a precise and uniform amount of dampening solution, in one embodiment an optical patterning subsystem 36, see FIG. 2 and FIG. 1, is used to selectively form a latent image in the dampening solution by image-wise evaporating the dampening solution layer using laser energy, for example. It should be noted here that the reimageable surface layer 20 should ideally absorb most of the energy as close to an upper surface 28 (FIG. 9) as possible, to minimize any energy wasted in heating the dampening solution and to minimize lateral spreading of the heat so as to maintain high spatial resolution capability. Alternatively, it may also be preferable to absorb most of the incident radiant (e.g., laser) energy within the dampening solution layer itself, for example, by including an appropriate radiation sensitive component within the dampening solution that is at least partially absorptive in the wavelengths of incident radiation, or alternatively by choosing a radiation source of the appropriate wavelength that is readily absorbed by the dampening solution (e.g., water has a peak absorption band near 2.94 micrometer wavelength). It will be understood that a variety of different systems and methods for delivering energy to pattern the dampening solution over the reimageable surface may be employed with the various system components disclosed and claimed herein. However, the particular patterning system and method do not limit the present disclosure.

Figure 9:
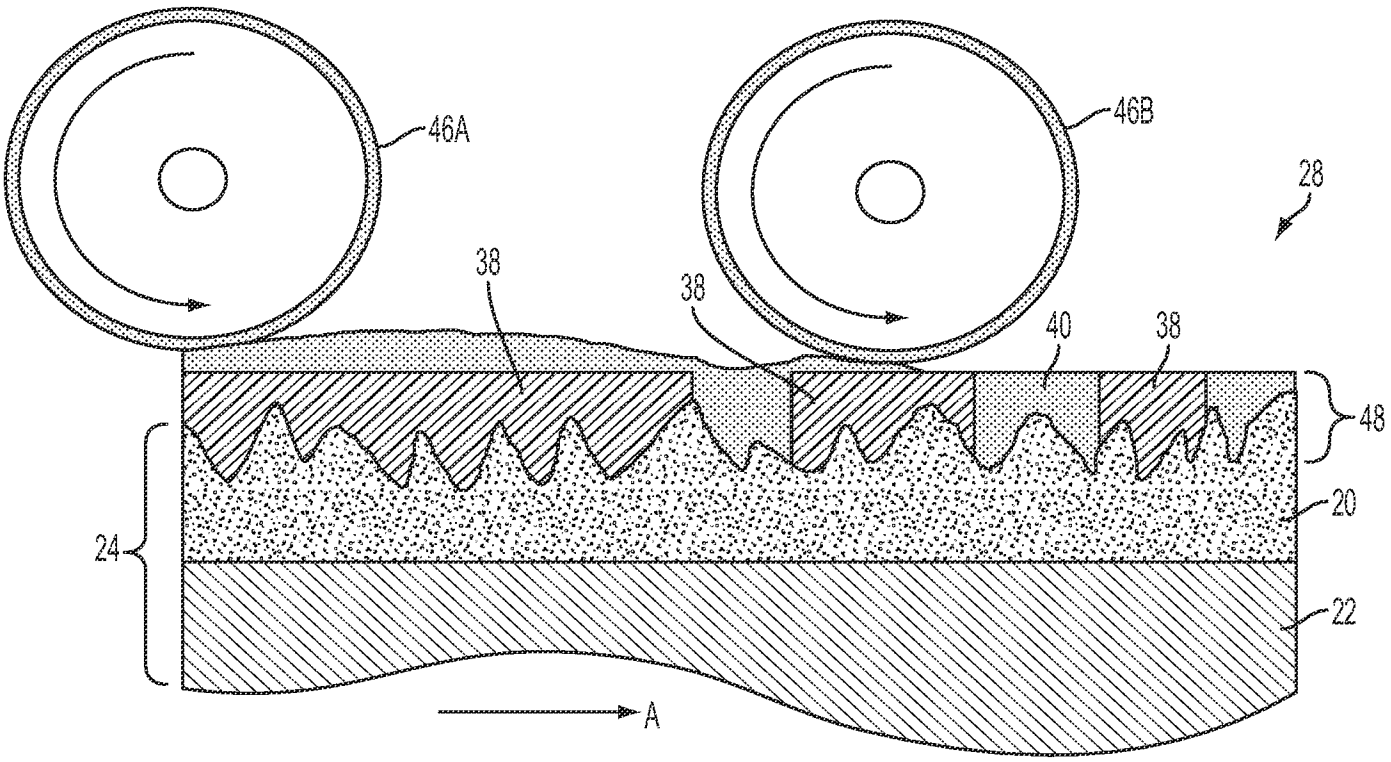
FIG. 9 is a side view of an inker subsystem used to apply a uniform layer of ink over a patterned layer of dampening solution and portions of a reimageable surface layer exposed by the patterning of the dampening solution in accordance to an embodiment.

Following patterning of the dampening solution layer 32, an inker subsystem 46 is used to apply a uniform layer 48, FIG. 9, of ink over the layer of dampening solution 32 and reimageable surface layer 20. In addition, an air knife 44 may be optionally directed towards reimageable surface layer 20 to control airflow over the surface layer before the inking subsystem 46 for the purpose of maintaining clean dry air supply, a controlled air temperature and reducing dust contamination. Inker subsystem 46 may consist of a "keyless" system using an anilox roller to meter an offset ink onto one or more forming rollers 46*a*, 46*b*. Alternatively, inker subsystem 46 may consist of more traditional elements with a series of metering rollers that use electromechanical keys to determine the precise feed rate of the ink. The general aspects of inker subsystem 46 will depend on the application of the present disclosure, and will be well understood by one skilled in the art.

In order for ink from inker subsystem 46 to initially wet over the reimageable surface layer 20, the ink must have low enough cohesive energy to split onto the exposed portions of the reimageable surface layer 20 (ink receiving dampening solution voids 40) and also be hydrophobic enough to be rejected at dampening solution regions 38. Since the dampening solution is low viscosity and oleophobic, areas covered by dampening solution naturally reject all ink because splitting naturally occurs in the dampening solution layer which has very low dynamic cohesive energy. In areas without dampening solution, if the cohesive forces between the ink are sufficiently lower than the adhesive forces between the ink and the reimageable surface layer 20, the ink will split between these regions at the exit of the forming roller nip. The ink employed should therefore have a relatively low viscosity in order to promote better filling of voids 40 and better adhesion to reimageable surface layer 20. For example, if an otherwise known UV ink is employed, and the reimageable surface layer 20 is comprised of silicone, the viscosity and viscoelasticity of the ink will likely need to be modified slightly to lower its cohesion and thereby be able to wet the silicone. Adding a small percentage of low molecular weight monomer or using a lower viscosity oligomer in the ink formulation can accomplish this rheology modification. In addition, wetting and leveling agents may be added to the ink in order to further lower its surface tension in order to better wet the silicone surface.

In addition to this rheological consideration, it is also important that the ink composition maintain a hydrophobic character so that it is rejected by dampening solution regions 38. This can be maintained by choosing offset ink resins and solvents that are hydrophobic and have non-polar chemical groups (molecules). When dampening solution covers layer 20, the ink will then not be able to diffuse or emulsify into the dampening solution quickly and because the dampening solution is much lower viscosity than the ink, film splitting occurs entirely within the dampening solution layer, thereby rejecting ink any ink from adhering to areas on layer 20 covered with an adequate amount of dampening solution. In general, the dampening solution thickness covering layer 20 may be between 0.1 μm-4.0 μm, and in one embodiment 0.2 μm-2.0 μm depending upon the exact nature of the surface texture. The thickness of the ink coated on roller 46*a* and optional roller 46*b* can be controlled by adjusting the feed rate of the ink through the roller system using distribution rollers, adjusting the pressure between feed rollers and the final form rollers 46*a*, 46*b* (optional), and by using ink keys to adjust the flow off of an ink tray (show as part of 46). Ideally, the thickness of the ink presented to the form rollers 46*a*, 46*b* should be at least twice the final thickness desired to transfer to the reimageable layer 20 as film splitting occurs. It is also possible to use a keyless system which can control the overall ink film thickness by using an anilox roller with uniformly formed ink carrying pits and maintaining the temperature to achieve the desired ink viscosity. Typically, the final film thickness may be approximately 1-2 mm. Ideally, an optimized ink system 46 splits onto the reimageable surface at a ratio of approximately 50:50 (i.e., 50% remains on the ink forming rollers and 50% is transferred to the reimageable surface at each pass). However, other splitting ratios may be acceptable as long as the splitting ratio is well controlled. For example, for 70:30 splitting, the ink layer over reimageable surface layer 20 is 30% of its nominal thickness when it is present on the outer surface of the forming rollers. It is well known that reducing an ink layer thickness reduces its ability to further split. This reduction in thickness helps the ink to come off from the reimageable surface very cleanly with residual background ink left behind. However, the cohesive strength or internal tack of the ink also plays an important role.

There are two competing results desired at this point. First, the ink must flow easily into voids 40 so as to be placed properly for subsequent image formation. Furthermore, the ink should flow easily over and off of dampening solution regions 38. However, it is desirable that the ink stick together in the process of separating from dampening solution regions 38, and ultimately it is also desirable that the ink adhere to the substrate and to itself as it is transferred out of voids 40 (FIG. 9) onto the substrate both to fully transfer the ink (fully empting voids 40) and to limit bleeding of ink at the substrate. The ink is next transferred to substrate 14 at transfer subsystem 70. In the embodiment illustrated in FIG. 8, this is accomplished by passing substrate 14 through nip 16 between imaging member 12 and impression roller 18. Adequate pressure is applied between imaging member 12 and impression roller 18 such that the ink within voids 40 (FIG. 9) is brought into physical contact with substrate 14. Adhesion of the ink to substrate 14 and strong internal cohesion cause the ink to separate from reimageable surface layer 20 and adhere to substrate 14. Impression roller or other elements of nip 16 may be cooled to further enhance the transfer of the inked latent image to substrate 14. Indeed, substrate 14, itself, may be maintained at a relatively colder temperature than the ink on imaging member 12, or locally cooled, to assist in the ink transfer process. The ink can be transferred off of reimageable surface layer 20 with greater than 95% efficiency as measured by mass, and can exceed 99% efficiency with system optimization.

With reference to FIG. 9, a portion of imaging member 12 is shown in cross-section. In one embodiment, imaging member 12 comprises a thin reimageable surface layer 20 formed over a structural mounting layer 22 (for example metal, ceramic, plastic, etc.), which together forms a reimaging portion 24 that forms a rewriteable printing blanket. Reimaging portion 24 may further comprise additional structural layers, such as intermediate layer (Not Shown) below reimageable surface layer 20 and either above or below structural mounting layer 22. Intermediate layer may be electrically insulating (or conducting), thermally insulating (or conducting), have variable compressibility and durometer, and so forth. In one embodiment, intermediate layer is composed of closed cell polymer foamed sheets and woven mesh layers (for example, cotton) laminated together with very thin layers of adhesive. Typically, blankets are optimized in terms of compressibility and durometer using a 3-4 plylayer system that is between 1-3 mm thick with a thin top surface layer 20 designed to have optimized roughness and surface energy properties. Reimaging portion 24 may take the form of a stand-alone drum or web, or a flat blanket wrapped around a cylinder core. In another embodiment the reimageable portion 24 is a continuous elastic sleeve placed over cylinder core. Flat plate, belt, and web arrangements (which may or may not be supported by an underlying drum configuration) are also within the scope of the present disclosure. For the purposes of the following discussion, it will be assumed that reimageable portion 24 is carried by cylinder core, although it will be understood that many different arrangements, as discussed above, are contemplated by the present disclosure.

Reimageable surface layer 20 consists of a polymer such as polydimethylsiloxane (PDMS, or more commonly called silicone) for example with a wear resistant filler material such as silica to help strengthen the silicone and optimize its durometer, and may contain catalyst particles that help to cure and cross link the silicone material. Alternatively, silicone moisture cure (aka tin cure) silicone as opposed to catalyst cure (aka platinum cure) silicone may be used. Reimageable surface layer 20 may optionally contain a small percentage of radiation sensitive particulate material dispersed therein that can absorb laser energy highly efficiently. In one embodiment, radiation sensitivity may be obtained by mixing a small percentage of carbon black, for example in the form of microscopic (e.g., of average particle size less than 10 μm or nanoscopic particles (e.g., of average particle size less than 1000 nm) or nanotubes, into the polymer. Other radiation sensitive materials that can be disposed in the silicone include graphene, iron oxide nano particles, nickel plated nano particles, and the like. Relative motion between imaging member or moving surface and inking subsystem, for example in the direction of arrow A, permits a process-direction inking.

Figure 10:
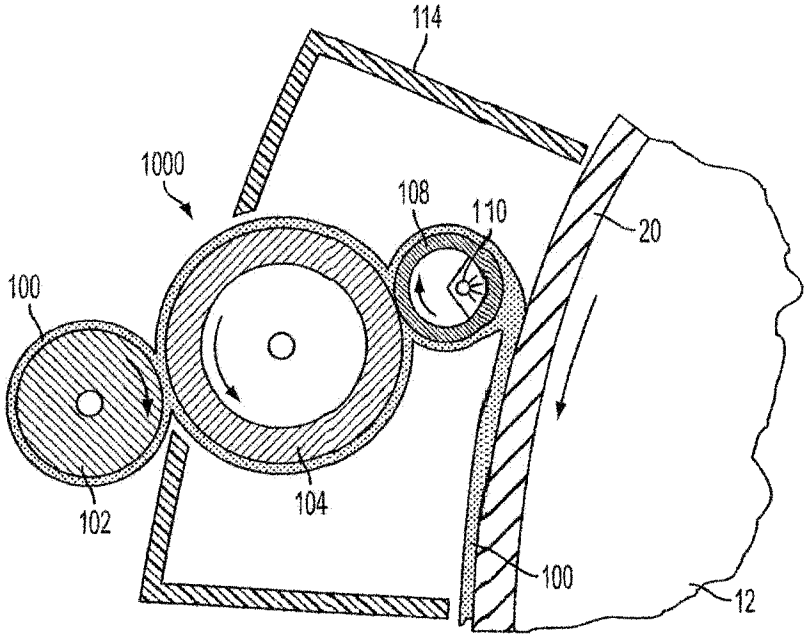
FIG. 10 is a side view of an inker subsystem used to apply a uniform layer of ink having a controlled rheology through ink pre-heating over a patterned layer of dampening solution and portions of a reimageable surface layer exposed by the patterning of the dampening solution in accordance to an embodiment.

One exemplary apparatus 1000 for accomplishing heating over a minimal time is illustrated in FIG. 10. Initially, ink 1000 is carried from a room temperature reservoir (not shown) by roller 102 to an intermediate (or inking) roller 104, which may be actively cooled by an appropriate mechanism such as conductive or convective cooling, using a cool-fluid source, cool-gas (e.g., air, nitrogen, argon, etc.) source, a cool roller in physical contact with roller 102, etc. (not shown), either inside of or outside of intermediate roller 104 (or both). Ink 100 is then transferred to heated nip roller 108, which is heated from the inside by a heat source 110 such as hot air (or other heated fluid) heating, radiant heating, electrically resistive heating, light-based heating, or chemical-reaction induced heating. The material, dimensions, and other attributes of heated nip roller 108 are selected such that any heat energy imparted from heat source 110 thereto is minimized. For example, with heated nip roller 108 formed of transparent or at least translucent material, radiation can be absorbed directly by ink 100. In this case, the radiation spectrum or wavelength is selected to match the absorption spectrum of ink 100. Alternatively, radiation can be absorbed by the material comprising heated nip roller 108, and thereafter transferred to ink 100. In this case, heater nip roller 108 may comprise a thermally conductive metal such as copper, aluminum, etc. If infrared radiation (IR) is employed, the thermally conductive metal may be placed over a roller body which is transparent to IR radiation, such as plastic or glass, to provide high thermal diffusivity and low heat capacity.

In a still further approach, a heat pipe system may be incorporated within heated nip roller 108. Heated nip roller 108 may itself comprise a heating mechanism and at least one sealed, fluid-filled cavity within a cylindrical housing (e.g., double cylindrical walls with an enclosed annular cavity forming the heat pipe structure). The cavity is maintained at a controlled internal pressure corresponding to the vapor pressure of the enclosed fluid near the temperature at which effective heat transfer is desired. Through constant phase change (vaporization) at a "hot" (i.e., heat source) portion of the cavity, followed by transfer of the vaporized fluid to a "cold" (i.e., heat sink) portion of the cavity, and its subsequent condensation near the heat sink portion, large amounts of heat can be quickly transferred due to the rapid phase change heat transfer effects. Low thermal mass is required, e.g., to enable a rapid and power-efficient temperature rise in ink 100. See, e.g., U.S. Pat. No. 3,677,329, incorporated herein by reference.

Figure 11:
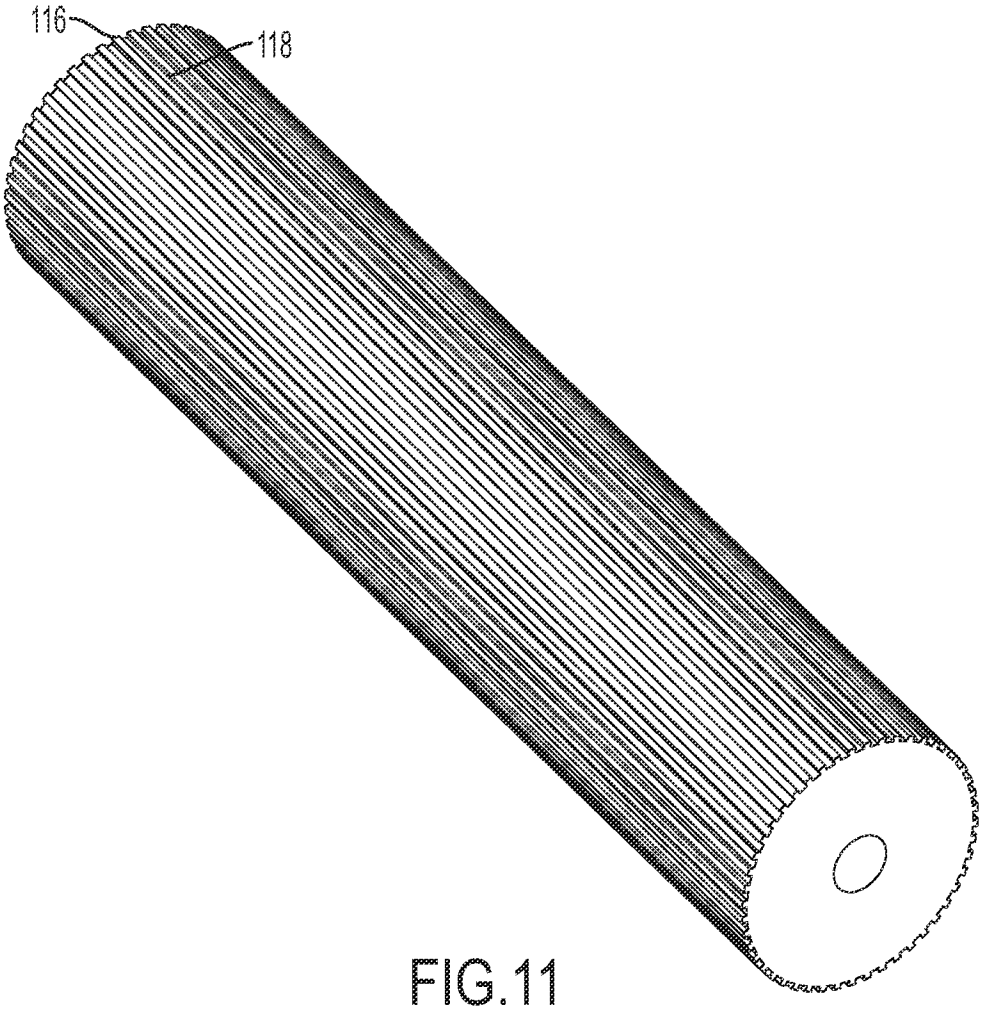
FIG. 11 is a perspective view of an ink roller divided into individually addressable regions in a direction parallel to a longitudinal axis of the roller in accordance to an embodiment.

As shown in FIG. 11, a heating roller 116 is divided into individually addressable regions 118 in a direction parallel to a longitudinal axis of the heating roller. Control over local temperature (e.g., specifically in the region of ink transfer) of the roller can then be provided. The temperature at each individually addressable region can be controlled, for example as a function of an image being formed by the variable data lithography system, as well as a function of the temperature at which a desired modification of the complex viscoelastic modulus of the ink is obtained.

Figure 12:
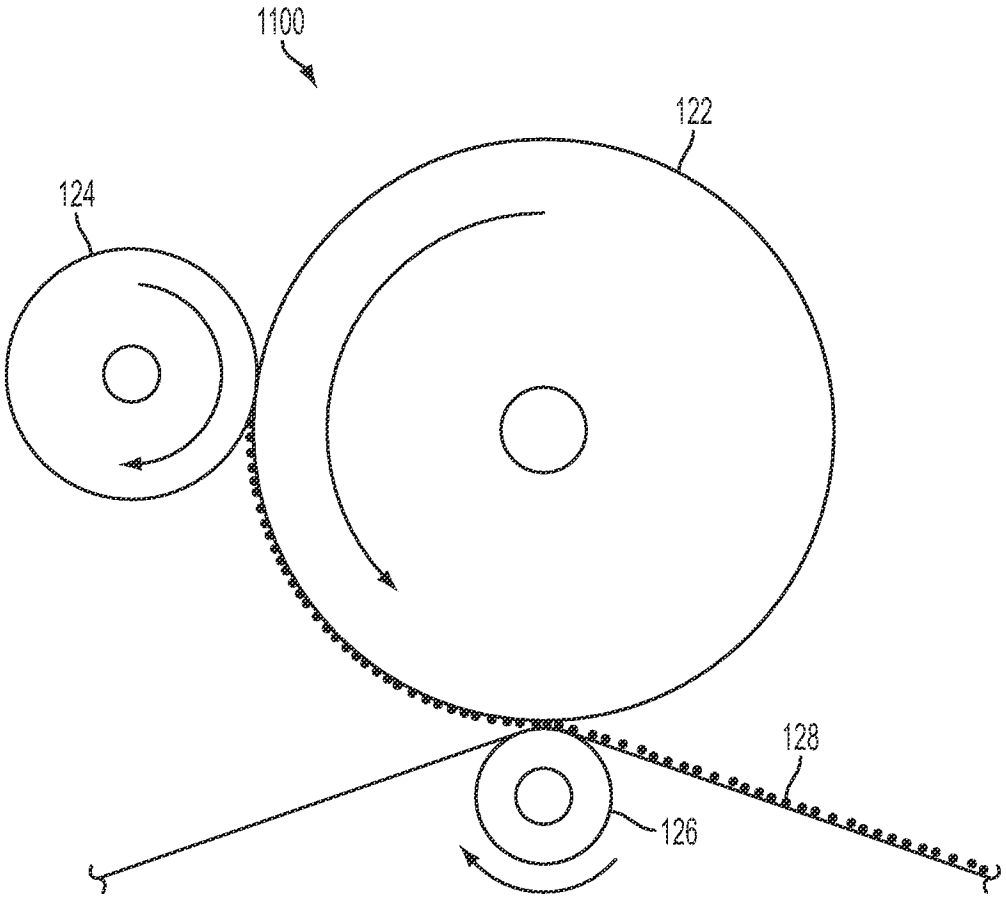
FIG. 12 is a side view of an inking roller and transfer nip roller illustrating the relatively much larger diameter of the inking roller as compared to the transfer nip roller in accordance to an embodiment.

As shown in FIG. 12, the relative sizes of various of the component elements of the system 1100 may provide a further increase in ink transfer efficiency of ink 128 to the imaging member. In FIG. 12, the diameter of the inking roller 124 is relatively much larger than the diameter of the transfer nip roller 126. The relatively large diameter inking roller 124 presents a relatively slow separation from the inking roller 124 to the reimageable surface layer 122, promoting ink transfer to the reimageable surface layer 122. The relatively small diameter transfer nip roller 126 presents a relatively fast separation from the reimageable surface layer 122 to the substrate, promoting efficient transfer of the ink 128 from the reimageable surface layer 122.

FIG. 1 is a side view of a system for variable lithography in accordance to an embodiment.

The digital offset printing process is depicted in FIG. 1. At station 105, a fountain solution is used to dampen a silicone imaging plate on an imaging drum 12. The fountain solution forms a film on the silicone plate that is on the order of one (1) micron thick. The drum rotates to an exposure station 36 where a high power laser imager is used to remove the fountain solution at the locations where the image pixels are to be formed. This forms a fountain solution based latent image. Details of the exposure station can be found, for example, in U.S. Pat. No. 8,508,791, entitled "IMAGE FEEDFORWARD LASER POWER CONTROL FOR A MULTI-MIRROR BASED HIGH POWER IMAGER", reference. The drum 12 then rotates to a development station 140 where lithographic ink is brought into contact with the fountain solution based latent image and ink develops onto the places where the laser has removed the fountain solution. An inker unit 145 with an ink bath uses a heater device 150 to dispense the ink in a controlled amount. An ink train 115 thins and displaces the ink down to the central imaging cylinder 12 or imaging member. The ink is hydrophobic, hydrophobic ink is repelled by water and prevented from attaching thereto. In station 120, UV light may be applied so that photo-initiators in the ink may partially cure the ink to prepare it for high efficiency transfer. The drum then rotates to a transfer station 125 where the ink is transferred to a printing media 135 such as paper. The silicone plate is compliant, so an offset blanket is not used to aid transfer. UV light may be applied to the paper with ink to fully cure the ink on the paper. The ink is on the order of one micron pile height on the paper. A Cleaning subsystem 130 then cleans the drum and prepares it for the next imaging revolution.

A main difference between traditional lithographic offset printing and the variable data lithographic print process is that every image can be different, as in all digital printing. This is often referred to as Variable Data printing. Traditional lithographic offset is inherently a reprographic process in that all images for each revolution of the image drum are the same. Thus the mean ink throughput for each drum revolution is the same, and the critical ink-to-fountain-solution ratio is the same for each revolution. The process is tuned manually, an acceptable step since there is little change in the ink demand between printing cycles, by an operator to find the correct ink supply rate to match the ink load and the image content, and to also match the ink and fountain solution mixture. The operator makes ink supply adjustments and visually inspects the printed output to perform the manual tuning process. In the variable data lithographic print process those limitations are overcome by using inker unit 140 with a heater device 150 to make adjustments relative to the varying ink load of the image stream.

FIG. 2 is a schematic side elevation view of a variable data lithography system with keyless inker and feedforward and feedback control loops in accordance to an embodiment. A print job consisting of a plurality of images is received at image path 205. The print job is separated into component images each representing a page of a document to be reproduced. The image is tiled into sub-images of vertical stripes of approximately 1 inch wide by 1 pixel horizontal scan data (pixels) that are then associated with a corresponding ink bath to provide the necessary ink. For example, in a variable data lithography system having thirty six (36) zones the original image is segmented into thirty six or more distinct strips. These strips are then exposed on the imaging cylinder (lasered) and the strips are then mapped to the ink roll to serve as individual zones with their own inking requirements. After rendering by the exposure station 36 the image is ready to receive ink.

While the image is being rendered by the exposure station, or even before so, the development station formulates the ink demand for each of the zones by performing pixel counting. The sub-image stream is used by pixel counter module 210 to determine a pixel count which is indicative of the anticipated ink usage, at any point in time, when actually printing the print job on the variable data lithographic printer. The pixel count can be determined by means of a simple algorithm, or by a table look up. In order to ensure precise prediction of ink usage, a weighing factor might be taken into consideration to take care of printer or job specific considerations. The pixel count is proportional to the number of pixels to be inked. A pixel counter counts the number of pixels to be imaged with ink on each stripe of vertical stripes of approximately 1 inch wide by 1 pixel horizontal scanline data; for each color. The pixel count information is stored memory.

The various optional rotating rollers in the ink train 115 cause a substantial lateral distribution of the ink, so that the amount of ink supplied to a given segment at the imaging member is not only dependent on the ink bath associated with that segment, but also on adjacent ink bath zone. In other words, as the ink travels from the inker unit 145 to the imaging member/cylinder via several laterally rotating rollers, a certain amount of ink bleeds from one zone on the ink roll to another.

The ink is dispensed at an inker unit 145 having a lower section to receive and store ink from an external source. The inker unit 145 further comprises heated ink baths whose temperatures are regulated by temperature control module 240. The inker is divided into zones and each zone is responsible for providing ink to a part of an ink roll. The disclosed embodiment will be described with thirty six ink zones, i.e., with thirty six ink baths along the lateral extent of the inker roll.

The ink is picked up from the inker unit 145 by an inking roller. An inker path consisting of a series of rollers passes and spreads the ink until it gets to the imaging member.

Figure 4:
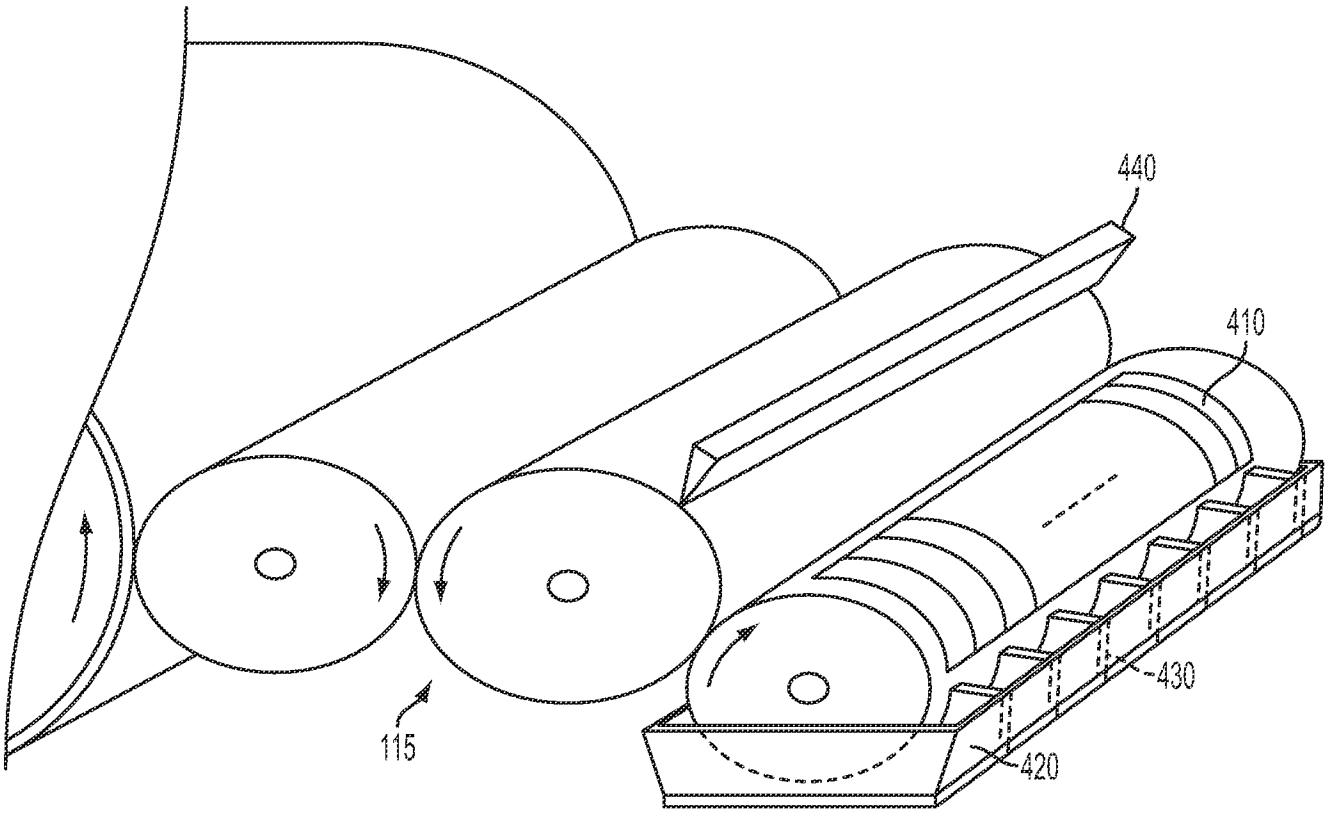
FIG. 4 is a view of a plurality of ink baths with heaters adjustable to control the temperature to an individual segment of an ink roll in accordance to an embodiment.

The inking roll is divided into segments, FIG. 4, which leads to equal sized segments throughout all of the inker paths. These segments are discrete elements that can be processed in digitized or discretized format. The number of ink baths at the inker unit of the exemplary embodiment described herein defines thirty six zones. There could be single ink bath per segment on the inker roll or any other suitable ratio. A ratio of one ink bath per three segments of the ink roll is more than adequate. Several zone fields are further defined about the periphery of the inking roller along its circumference that can be used to ascertain the delays and transient thermal dynamics of the ink train 115.

A feedforward/feedback controller 215 uses the required ink demand into the future, as determined by the pixel counting module 210. The feedforward controller 217 determines the ink load as a function of time into the future for what is about to be printed from the received data from the pixel counting module 210. The feedforward controller 217 is able to anticipate the required ink supply based on knowledge of the future ink demand from the pixel counting module. This ink demand can be used by the feedforward controller to generate a first control function which can be used to control the temperature at one of the ink baths. The robustness of the control signal from the feedforward controller 217 needs to account for the delay and transient dynamics of the ink train 115 as well as feedback from current ink density measurements to determine a current set point for the temperature control module 240 at a targeted ink bath. Bringing the ink bath to a set temperature will insure that the inking train 115 will receive the necessary ink.

A signal from an ink density sensor 230 or densitometer is converted to an ink density value through known logarithmic techniques. The particular advantage of ink density measurement is the fact that the density value has a simple relationship with the ink layer thickness. It is possible for a large number of measured values to be obtained on a measurement field of given size over a short period of time. The density measurements are made available to both the feedforward controller 217 and the feedback controller 219 in real time.

The feedback controller 219 uses the results of an inker model 220 to modify the first control function. The inker model 220 models the inker transient thermal dynamics. The model is updated over time using the ink density sensor 230. This process is performed for each of the cross process location associated with an ink roll. This is typically on the order of one inch in the cross process direction of the ink roll. The feedback density sensor is also used to update the inker model on a periodic basis. Also feedback parameters 225 such as gain signals and process speed are used to increase the robustness of the model.

The feedforward control parameters are adjusted for the particular inker configuration to reduce the error and maintain stability, i.e., to make sure that the prediction of the pixel count and the inker model can reflect the behavior of the system under a myriad of conditions. The transient response of the inker system depends on the speed at which the rollers at the ink train 115 are driven, as well as the number of cooperating rollers. The main objective is to run the feedback signals to reduce the error signal to zero.

A command for the ink demand for each zone is entered into a feedforward/feedback controller 215. The feedforward/feedback controller 215 defines the temperature response according to its transfer function for the temperature control module as a function of the temperature at the ink bath. The closed-loop system for the presetting obtains its error signal from a measuring bar which measures optical density which is related to the ink thickness of each of the thirty six zones at the imaging member from the feedback loop that includes the coverage input with reference to each zone. The coverage represents the desired zonal coverage determined by the "tone reproduction curve" (TRC) and ink load for the print job.

Figure 3:
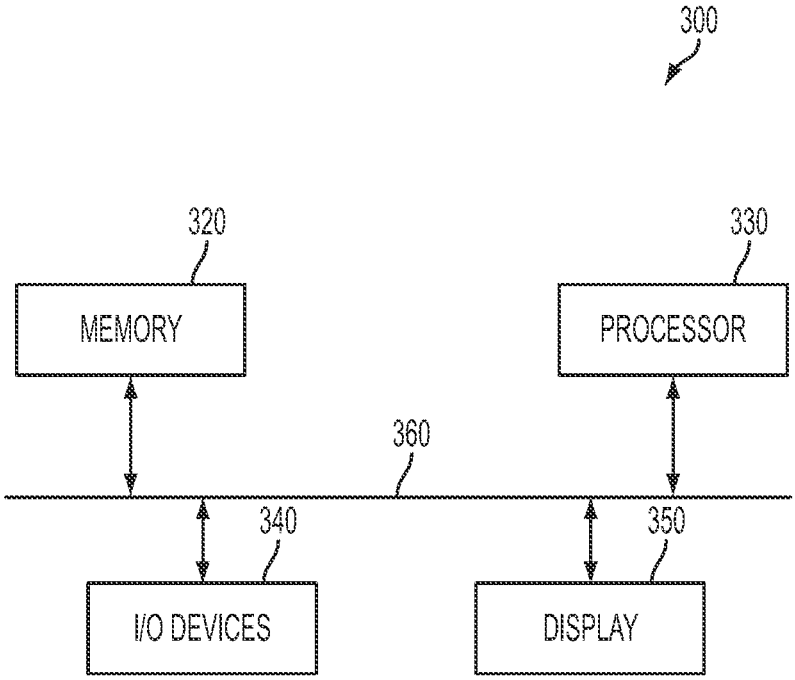
FIG. 3 illustrates a block diagram of a controller with a processor for executing instructions to automatically control temperature of an ink bath in a variable data lithographic printing system in accordance to an embodiment.

FIG. 3 illustrates a block diagram of a controller 300 with a processor for executing instructions to automatically control temperature of an ink bath in digital printing system in accordance to an embodiment.

The controller 300 may be embodied within devices such as a desktop computer, a laptop computer, a handheld computer, an embedded processor, a handheld communication device, or another type of computing device, or the like. The controller 300 may include a memory 320, a processor 330, input/output devices 340, a display 330 and a bus 360. The bus 360 may permit communication and transfer of signals among the components of the computing device 300.

Processor 330 may include at least one conventional processor or microprocessor that interprets and executes instructions. The processor 330 may be a general purpose processor or a special purpose integrated circuit, such as an ASIC, and may include more than one processor section. Additionally, the controller 300 may include a plurality of processors 330.

Memory 320 may be a random access memory (RAM) or another type of dynamic storage device that stores information and instructions for execution by processor 330. Memory 320 may also include a read-only memory (ROM) which may include a conventional ROM device or another type of static storage device that stores static information and instructions for processor 330. The memory 320 may be any memory device that stores data for use by controller 300.

Input/output devices 340 (I/O devices) may include one or more conventional input mechanisms that permit a user to input information to the controller 300, such as a microphone, touchpad, keypad, keyboard, mouse, pen, stylus, voice recognition device, buttons, and the like, and output mechanisms such as one or more conventional mechanisms that output information to the user, including a display, one or more speakers, a storage medium, such as a memory, magnetic or optical disk, disk drive, a printer device, and the like, and/or interfaces for the above. The display 330 may typically be an LCD or CRT display as used on many conventional computing devices, or any other type of display device.

The controller 300 may perform functions in response to processor 330 by executing sequences of instructions or instruction sets contained in a computer-readable medium, such as, for example, memory 320. Such instructions may be read into memory 320 from another computer-readable medium, such as a storage device, or from a separate device via a communication interface, or may be downloaded from an external source such as the Internet. The controller 300 may be a stand-alone controller, such as a personal computer, or may be connected to a network such as an intranet, the Internet, and the like. Other elements may be included with the controller 300 as needed.

The memory 320 may store instructions that may be executed by the processor to perform various functions. For example, the memory may store instructions to control the inking train, the executable instructions to control the temperature of the at least one ink bath, the executable instructions capable of directing a processor to perform receiving a print job comprising at least one image; separating the at least one image into cross-process direction sub-images associated with the at least one ink bath; providing an output in accordance to a first control function which is adaptable to control the temperature of the at least one ink bath based on an ink load demand for each sub-image; controlling the at least one heater element to adjust the ink supply in the at least one ink bath in accordance to the first control function; updating the stored inker dynamic model for the inking train with the measured ink density.

FIG. 4 is a view of an ink bath adjustable to control the temperature to an individual segment of an ink roll in accordance to an embodiment. FIG. 4 shows a roller in the ink train 115 that may be inked differently over its axial length 410 by means of ink baths so that the roller shell is subdivided into zones $Z_1, Z_2 \ldots Z_n$. The number and dimensions of the zones can be distributed in the cross-process direction to meet different printing needs and projects. So for a 36 inch cross-process direction print width, there may be 36 to 38 ink baths regulating the ink supply across the cross-process direction. Every ink bath 420 has a dedicated heater element 430 to maintain the temperature of the ink at a dispensing level. The ink baths are separated into segments ($S_1, S_2 \ldots S_n$) and can be as many as the number of zones or as few as 1 ink bath for all the individual ink regions on the roll. In the preferred embodiments there is one ink bath that services three ink regions on the roll. Each of these ink baths is provided with a respective temperature adjustment ($T_1, T_2 \ldots T_n$) that is separately controllable. The segments ($S_1, S_2 \ldots S_n$) are separated from each other by partitions within the ink bath or trough. These partitions need not provide a complete separation of the segments, however, they prevent liquid ink from flowing in the longitudinal direction in the ink trough. They cause ink material being in one segment to stay in that segment, even when the ink roller is rotated, and prevent substantial amounts of liquid from flowing from one zone to another. The temperature heaters 430 ($T_1, T_2 \ldots T_n$) may be controlled individually by feedforward/feedback controller 215. It may also be provided that the feedforward/feedback controller 215 sets a common basic heating temperature for all temperature adjustment heaters and that the individual adjustability is effective only above this basic heating temperature. It is only essential that the temperature of the respective segments ($S_1, S_2 \ldots S_3$) may be adjusted individually so that a different temperature may be set in each zone. Heater 430 is selected from a group consisting of resistive heater, inductive heater, electric heater, pipe heater, or a combination thereof.

Figure 5:
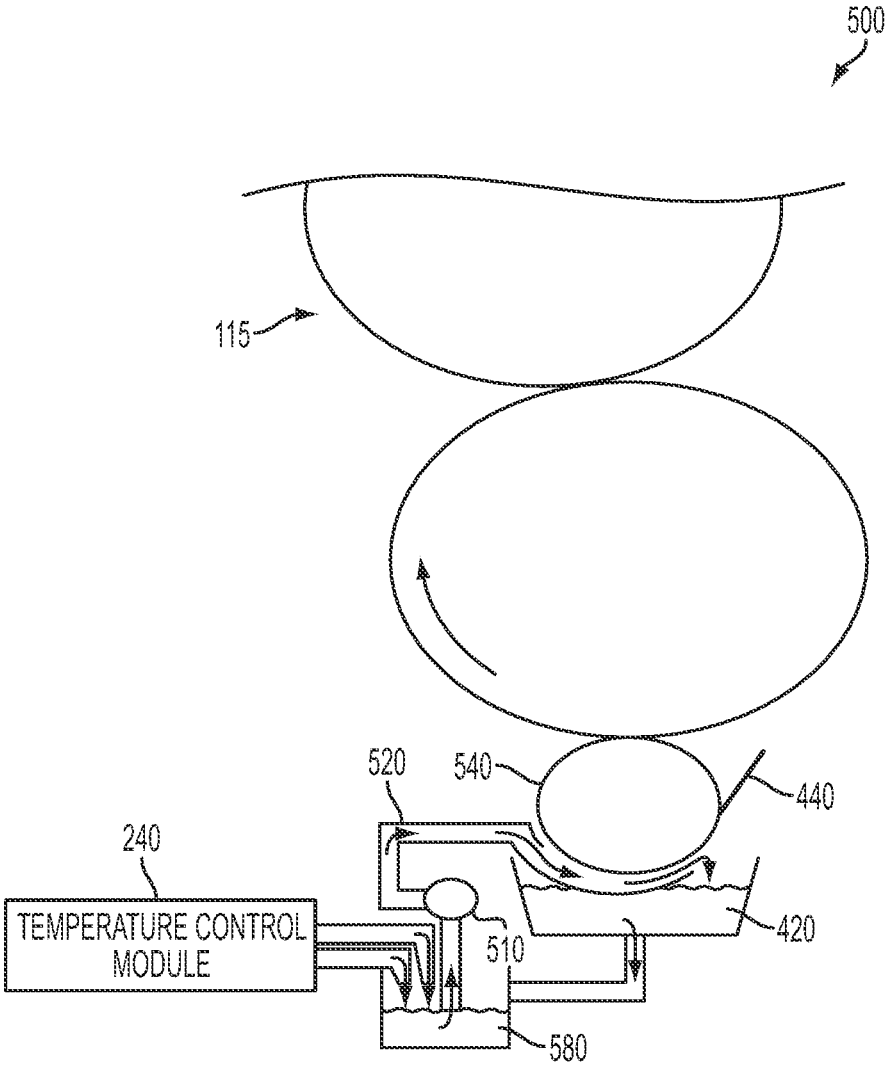
FIG. 5 is a view of an ink bath with temperature control module to control the temperature of an ink bath in a keyless Inking system in accordance to an embodiment.
Figure 6:
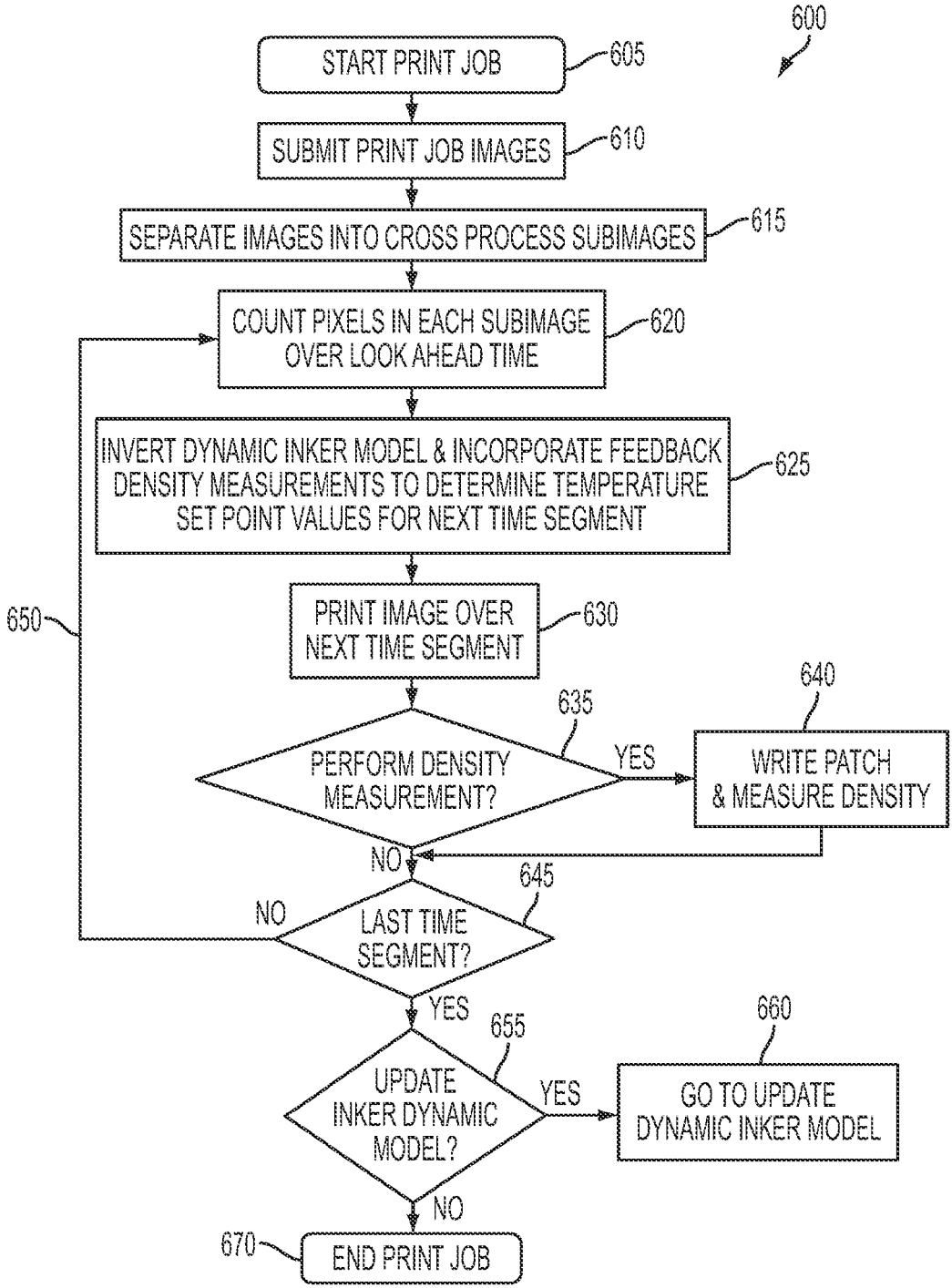
FIG. 6 is a flowchart of a method to control an inking unit for a variable data lithography system in accordance to an embodiment.

FIG. 5 is a view of an ink bath with temperature control module to control 500 the temperature of an ink bath in a keyless Inking system in accordance to an embodiment. In keyless inking, a mixing tank 580 prepares a homogeneous printing fluid mixture of materials for conveyance by means of ink system pump 510 and piping 520 to a keyless inking system similar to that depicted in FIG. 1. A drum 540 with small cavities (an anilox roll) is rotated into a position where part of its surface is immersed in an ink bath 420 and has its surface cavities overfilled with ink, then a doctor blade 440 is used to scrape the ink off of the drum 540 to a consistent ink quantity across the whole cross process length of the drum 540 no matter how much ink was removed on the previous anilox roll revolution. Ink can then be metered 510 onto an ink forming roller, developed onto the imaging drum, then finally transferred to the output media. Thus tuning of individual keys is not required and good image quality is achieved no matter what the variable ink demand is in both the process and cross process directions. Reload defects are avoided and blooming defects are avoided. In practice, some manual tuning may be required to adjust the mean ink supply. This tuning is performed by varying the temperature of the ink through temperature control module 240, FIG. 6 is a flowchart of a method 600 to control an inking unit for a variable data lithography system in accordance to an embodiment. Method 600 begins with the variable data lithographic printing machine receiving a print job in action 605. In action 610, the print job is separated into distinct images such as pages in a document.

Action 615 processes each image of the print job so as to separate the images into cross process sub-images. Each image is separated into cross-process direction ($Z_1, Z_2 \ldots Z_n$) sub-images associated with each ink bath zone.

Action 620 count pixels in each sub-image over a look-ahead time. A running pixel count is determined for each sub-image. The pixel count is performed for the look-ahead time, which is defined by the delay and transient response of the ink train 115.

In Action 625 the method inverts a dynamic model and incorporates feedback density measurements to determine motor setpoint values for the next time segment. The pixel count 620 is then used as an input into the inker inverse dynamic model to determine the feedforward portion of the control signal. In an embodiment, given the pixel count, the feedforward control signal value for time segment t, may be given by: $u_{ff}(t)=C_{ff}\ pc(t+t_{ff})+\beta_{ff}(1)\ u_{ff}(t-1)+\beta_{ff}(2)\ u_{ff}(t-2)+\ldots+\beta_{ff}(N_{ff})\ u_{ff}(t-N_{ff})$, where pc( ) is the pixel count, $t_{ff}$ is the delay through the ink train, $C_{ff}$ is a model parameter relating pixel count to ink load, $B_{ff}(\ )$ are model parameters related to the dynamics of the ink train, and $N_{ff}$ is the number of delay time segments to use in the model. The number of delay time segments to use in the model is dependent on the specific dynamics of the ink train. Note that the pixel count into the future (positive value of $t_{ff}$) is used in the equation. This makes sense since the ink load into the future is used to determine the present ink bath zone temperature setpoint to account for the delay through the ink train. The most recent density measurements, the density target, and the ink load when those density measurements were made and feedback gains are used to define the feedback portion of the control signal. In an embodiment, the feedback control signal at time segment t, is given by: $u_{fb}(t)=\alpha_{fb}(1)\ u_{fb}(t-1)+\alpha_{fb}(2)\ u_{fb}(t-2)+\ \ldots\ +\alpha_{fb}(L_{fb})\ u_{fb}(t-L_{fb})+\beta_{fb}(0)\ e_{fb}(t)+\beta_{fb}(1)\ e_{fb}(t-1)+\ldots+\beta_{fb}(M_{fb})\ e_{fb}(t-M_{fb})$ where $\alpha_{fb}(\ )$ are parameters related to the dynamics of the ink train, $L_{fb}$ is the number of terms used which is related to the dynamics of the ink train, $\beta_{fb}(\ )$ are parameters related to the weighting of past and present density errors and the desired responsiveness of the controller, $M_{fb}$ is the number of terms used in the error feedback portion of the controller and is related to desired responsiveness of the control, and $e_{fb}(t)$ is the density error (density target minus density actual). The feedforward portion of the control signal and the feedback portion of the control signal are then combined to define the aggregate control signal which is used to command the temperature control module 240 setpoint for the key associated with a cross-process direction sub-image. In an embodiment, this is given by: $u(t)=u_{ff}(t)+u_{fb}(t)$. This is repeated for all the sub-images in the cross-process direction ($Z_1, Z_2 \ldots Z_n$).

In action 630 the image is printed over the next time segment. The image is then printed over a time segment which corresponds to a fixed process direction length such as the turning of the imaging member.

In action 635 a decision is made whether to make density measurements at the current time. Density measurements are periodically performed. If a density measurement is to be performed at the current time, density patches are printed in inter-document zones and measured with a densitometer in action 640. Results are used in the control signal calculation by the feedforward controller and the feedback controller.

In action 645 the method determines if the last time segment determined. If the print job is not completed, the process goes back (650) to action 620 to update the pixel count based on the image or sub-image segments to be printed in the next time segment. Action 645 forwards control to action 666 for further processing if it is determined that the print job has been completed. In action 655, it is determined if the inker dynamic model needs to be updated. If the inker model needs to be updated then control is passed (action 660) to method 700 for further processing. If the inker model is not to be updated or the update has been performed by action 600 control is passed to action 670 indicating that the print job is complete.

Figure 7:
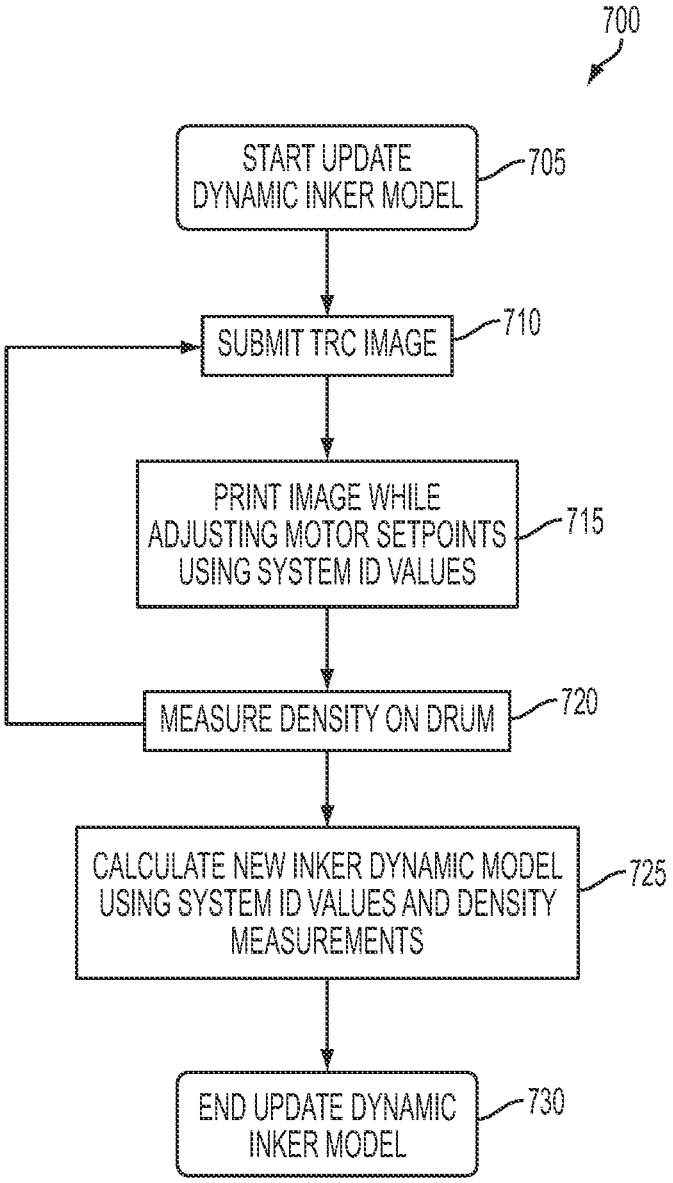
FIG. 7 is a flowchart of a method for updating a dynamic inker model usable with the method to control an inking unit in accordance to an embodiment.

FIG. 7 is a flowchart of a method for updating a dynamic inker model usable with the method to control an inking unit in accordance to an embodiment.

Method 700 begins with action 705, where the update dynamic inker model process is started. Control is then passed to action 710 for further processing.

In action 710, a print job that prints an image that spans all levels of the "tone reproduction curve" (TRC) is printed. Control is then passed to action 715 for further processing.

In action 715, temperature setpoints are adjusted while the TRC print job is being printed. The setpoint adjustments include step changes of various amplitude, sinusoidal variations of various amplitude, and pseudo-random sequences for various embodiments of the invention. Control is then passed to action 720 for further processing.

In action 720, the developed ink density on the drum is measured with a densitometer sensor. Actions 710, 715, and 720 are repeated until all data is collected. Control is then passed to action 725 for further processing.

In action 725, data is used to fit a dynamic model using known techniques from the field of system as is well known to those in the art Examples of fitting functions can be found from identification including time-domain, frequency domain, and non-linear techniques as disclosed in Ljung et al., "System Identification: Theory for the User, Second Edition", New Jersey, Prentice Hall, 1999. pp. i-672. QA402.L59. They include fitting a delay plus first order parameterized model to the step responses, fitting Nth order matrix Ordinary Differential Equation models using least squares techniques, fitting describing function models to the data, and fitting non-linear dynamical system models to the data. Note that the model may be such that parameters from the old dynamic inker model may be updated by a certain percentage change as defined by the new data. That is, the parameters themselves may be updated in an infinite impulse response (IIR) model where the updated parameter value is formed by adding a certain percentage of the old parameter value to a certain percentage of the new value. Therefore the model does not change abruptly. Control is then passed to action 730 for further processing.

In action 730, the method is completed and the updated dynamic inker model is ready for use.

In the preceding paragraphs, example embodiments of the invention were described. These embodiments are presented for purposes of illustration rather than of limitation, and minor changes may be made to the example embodiments without departing from the inventive principle or principles found therein. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. An digital lithographic image forming system, comprising:

an image member having a reimageable surface forming a different image on each rotation of the image member;

a keyless inking unit for metering ink onto the reimageable surface, the keyless inking unit comprising a plurality of heater elements positioned adjacent to each other across a width of the image member, a temperature of each of the plurality of heater elements being adjusted to control an ink feed in each of a plurality of individual ink bath zones associated respectively with each of the plurality of heater elements, each of the plurality of individual ink bath zones forming a sub-image into which the different image is divided in a cross process direction;

a pixel counter that counts a number of pixels to be imaged with ink in each sub-image over a look-ahead time, determines a running pixel count of the each sub-image and stores pixel count information in a memory;

a feedforward controller that (1) receives an input regarding a future ink load demand for the each sub-image in each different image formed on the reimageable surface of the image member on the each rotation of the image member, the ink load demand for the each sub image being based on the running pixel count of the each sub-image;

(2) determines the ink load demand as a function of the look-ahead time for the each sub-image to be printed, and (3) executes a control function that controls a temperature of each of the plurality of heater elements in each of the plurality of ink bath zones to deliver ink to the reimageable surface to meet the determined ink load demand for the each sub-image at the time in the future; and a separate feedback controller that modifies the control function in accordance with an inker dynamic model for the digital lithographic image forming system.

2. The system of claim 1, the ink load demand further comprising ink developed onto the reimageable surface according to a thermal dynamic for the at least one of the plurality of heater elements and an associated one of the plurality of ink bath zones.

3. The system of claim 1, the inker dynamic model being based on an ink density measurement, an ink density target, an ink load at a time of the ink density measurement, and a feedback gain.

4. The system of claim 3, the inker dynamic model being updated with at least one of data obtained after printing of the each different image, data obtained before printing of the each different image using density patches at predetermined locations of the reimageable surface and data obtained after printing of two or more of the each different images from the reimageable surface.

5. The system of claim 1, the at least one of the plurality of heater elements being selected from a group consisting of a resistive heater, an inductive heater, an electric heater, and a heat pipe.

6. The system of claim 1, the feedforward controller and the separate feedback controller being responsive to an ink density measurement obtained from the reimageable surface.

7. A method for delivering ink to a reimageable surface of an image member in a digital lithographic image forming device using a keyless inking unit having a plurality of heater elements that each heat a respective one of a plurality of ink bath zones in a cross-process direction across a width of the image member, comprising:

receiving, with a processor, a print job comprising a plurality of different images to be sequentially formed on the reimageable surface on each rotation of the image member;

separating, with the processor, each different image of the plurality of different images into cross-process direction sub-images associated with each of the plurality of heater elements and the respective one of the plurality of individual ink bath zones across the width of the image member;

counting, with a pixel counter, a number of pixels to be imaged with ink in each sub-image over a look-ahead time determining a running pixel count of the each sub-image;

storing pixel count information in a memory;

determining, with the processor, a future ink load demand for the each sub-image in the each different image to be formed on the reimageable surface of the image member on the each rotation of the image member, the future ink load demand for the each sub-image being based on the running pixel count of the each sub-image, the determining the future ink load demand being as a function of the look-ahead time for the each sub-image to be printed;

executing, with the processor, a control function that controls a temperature of each of the plurality of heater elements in each of the respective plurality of individual ink bath zones to deliver ink to the reimageable surface to meet the determined ink load demand for the each sub-image at the look-ahead time; and modifying the control function in accordance with an inker dynamic model for the digital lithographic image forming system.

8. The method of claim 7, the future ink load demand further comprising ink developed onto the reimageable surface according to a thermal dynamic for the at least one of the plurality of heater elements and an associated one of the plurality of individual ink bath zones.

9. The method of claim 7, the inker dynamic model being based on an ink density measurement, an ink density target, an ink load at a time of the ink density measurement, and a feedback gain.

10. The method of claim 9, the inker dynamic model being updated with at least one of data obtained after printing of the each different image, data obtained before printing of the each different image using density patches at predetermined locations of the reimageable surface, and data obtained after printing of two or more of the each different images from the reimageable surface.

11. The method of claim 7, the at least one of the plurality of heater elements being selected from a group consisting of a resistive heater, an inductive heater, an electric heater, and a heat pipe.

12. The method of claim 7, the control function and the inker dynamic model being responsive to an ink density measurement obtained from the reimageable surface.

* * * * *